United States Patent [19]

Nakatsubo et al.

[11] 4,099,863

[45] Jul. 11, 1978

[54] IMPROVED ELECTROGRAPHIC PROCESS FOR PRODUCING A PLURALITY OF COPIES

[75] Inventors: Toshio Nakatsubo; Masaji Nishikawa, both of Hachioji, Japan

[73] Assignee: Olympus Optical Co., Ltd., Tokyo, Japan

[21] Appl. No.: 744,268

[22] Filed: Nov. 23, 1976

[30] Foreign Application Priority Data

Nov. 27, 1975 [JP] Japan ..... 50-141113

[51] Int. Cl.[2] ..... G03G 15/00

[52] U.S. Cl. ..... 355/3 SC; 96/1 R

[58] Field of Search ..... 355/3 SC, 4, 3 TE; 96/1 R, 1 TE, 1.2; 361/225, 230

[56] References Cited

U.S. PATENT DOCUMENTS 4,022,527 5/1977 Jackson ..... 96/1 R X

*Primary Examiner*—Richard L. Moses

*Attorney, Agent, or Firm*—Haseltine, Lake & Waters

[57] ABSTRACT

An electrographic process for producing, an electrostatic charge image corresponding to an image to be recorded on a record sheet having a dielectric material layer, by modulating a flow of corona ions by an electrostatic latent image formed on a photosensitive screen is disclosed. The process comprises changing a bias electric voltage applied across two electric conductive layers of the photosensitive screen in a direction such that attenuation of the electrostatic latent image formed on the photosensitive layer is compensated in response to the number of copies to be obtained.

2 Claims, 6 Drawing Figures

IMPROVED ELECTROGRAPHIC PROCESS FOR PRODUCING A PLURALITY OF COPIES

BACKGROUND OF THE INVENTION

This invention relates to an electrographic process for producing, an electrostatic charge image corresponding to an image to be recorded on a record sheet having a dielectric material layer, by modulating a flow of corona ions by through an electrostatic latent image formed on a photosensitive screen.

Various kinds of such processes have heretofore been proposed. One of these processes which can freely and precisely control a picture image makes use of a photosensitive screen composed of four layers consisting of an insulating layer, two electric conductive layers formed on diametrically opposite sides of the insulating layer and a photosensitive layer formed on one of the two electric conductive layers. This process comprises a first step of uniformly charging the above mentioned photosensitive layer; a second step of illuminating the photosensitive layer with a light image to form an electrostatic latent image thereon; and a third step comprising locating a record sheet having a dielectric material layer in opposition to the photosensitive layer of the photosensitive screen. Thereafter a high electric voltage is applied across a grounded field electrode provided in the rear of the record sheet having the dielectric material layer and the electric conductive layer of the photosensitive screen. Next a bias electric voltage is applied across the two electric conductive layers of the photosensitive screen and then a flow of ions is directed from a corona discharge device arranged at the side of and spaced apart from the electric conductive layer of the photosensitive screen, through the photosensitive screen and toward the record sheet having the dielectric material layer whereby, an electrostatic charge image which corresponds to the electrostatic latent image formed on the photosensitive layer of the photosensitive screen is produced on the record sheet having the dielectric material layer.

Such conventional process has the advantage that the picture image can be controlled by adjusting the bias electric voltage applied across the two electric conductive layers of the photosensitive screen composed of the four layers and that a plurality of copies can be obtained by repeating the above mentioned third step after the electrostatic latent image has been formed on the photosensitive screen.

However, experimental tests have indicated that in such a process, if a plurality of copies are to be obtained, a picture image concentration becomes changed as a function of the number of copies. It is considered that such change of the picture image concentration is caused by dark attenuation properties of a photoconductive body and an undesirous curved flow of ions directed from the corona discharge device toward the record sheet. As a result, the above mentioned process has the disadvantage that copies having good quality picture image are limited in number and that a very large number of copies could not be obtained.

SUMMARY OF THE INVENTION

An object of the invention, therefore, is to provide an electrographic process which can obviate the above mentioned disadvantage of the conventional electrographic processes.

Another object of the invention is to provide an electrographic process where one can obtain a number of copies each having a constant picture image concentration by changing a bias electric voltage applied across two electric conductive layers of a photosensitive screen.

The invention is based on the recognition that the picture image concentration can be controlled by changing the bias electric voltage applied across the two electric conductive layers of the photosensitive screen.

A feature of the invention is the provision of an electrographic process which makes use of a photosensitive screen composed of four layers, consisting of an insulating layer, two electric conductive layers formed on diametrically opposite sides of the insulating layer and a photosensitive layer formed on one of the two electric conductive layers and comprises a first step of, uniformly charging the photosensitive layer, a second step of illuminating the photosensitive layer with a light image to form an electrostatic latent image thereon, and a third step comprising disposing record sheet having a dielectric material layer in opposition to the photosensitive layer of the photosensitive screen; thereafter applying a high electric voltage across a grounded field electrode provided in the rear of the record sheet with the dielectric material layer and the electric conductive layer of the photosensitive screen; applying a bias electric voltage across the two electric conductive layers of the photosensitive screen; and directing a flow of ions from a corona discharge device arranged at the side of and spaced apart from the electric conductive layer of the photosensitive screen, through the photosensitive screen toward the record sheet having the dielectric material layer whereby, an electrostatic charge image which corresponds to the electrostatic latent image formed on the photosensitive screen is produced on the record sheet. The process comprises repeating the third step only to obtain a plurality of copies and changing the bias electric voltage applied across the two electric conductive layers of the photosensitive screen in such a direction, that attenuation of the electrostatic latent image formed on the photosensitive layer is compensated in response to the number of copies to be obtained.

The inventors have found out by experimental test results that if the bias electric voltage applied across the two electric conductive layers of the photosensitive screen is made constant, a phenomenon occurs enabling the picture image concentration of a second copy to become higher than that of a first copy and the picture image concentration of copies successive to the second copy is gradually decreased. Theoretical reasons why such phenomenon occurs are not yet understood.

Another feature of the invention is the provision of an electrographic process which is based on the above mentioned recognition. Accordingly, a value of the bias electric voltage applied across the two electric conductive layers of the photosensitive screen is determined, when a first copy is obtained from the electrostatic latent image formed on the photosensitive screen. The such that value of the bias electric voltage thus determined is not associated with a direction of changing the bias electric voltage applied when a second copy and copies successive thereto are obtained.

The invention will now be described in greater detail with reference to the accompanying drawings, wherein:

IN THE DRAWINGS

FIGS. 1A, 1B and 1C schematically illustrate three successive steps of an electrographic process according to the invention, respectively;

PREFERRED EMBODIMENT

Figure 1A:
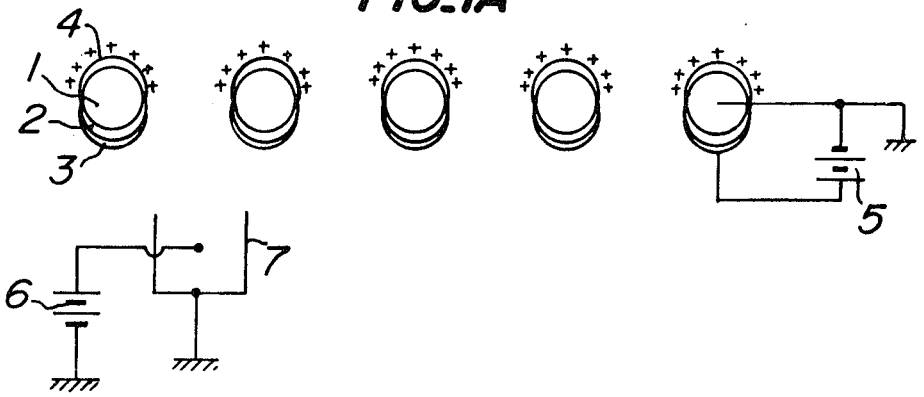
Figure 1B:
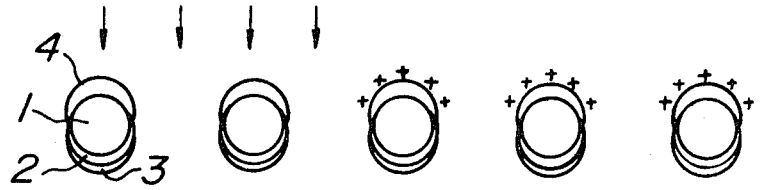
Figure 1C:
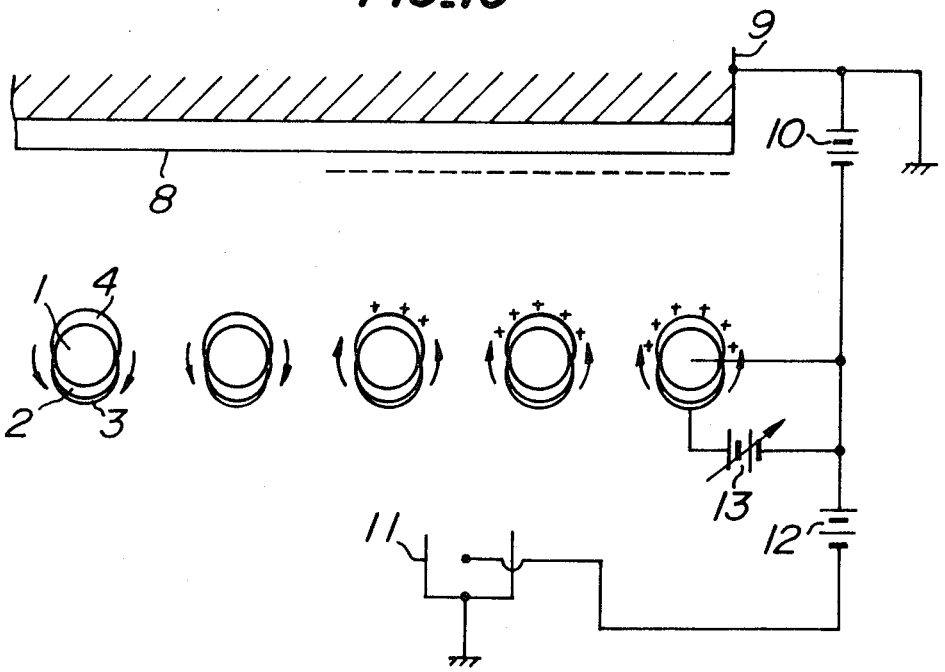

In FIGS. 1A, 1B and 1C successive steps of modulating a flow of corona ions are shown by means of an electrostatic latent image formed on a photoconductive and photosensitive screen to form an electrostatic charge image on a record sheet having a dielectric material layer. The photosensitive screen is composed of a mesh-shaped electric conductive core 1, an insulating layer 2 formed on one side of the core 1, an electric conductive layer 3 formed on the insulating layer 2 and a photosensitive layer 4 formed on diametrically opposite side of the core 1. A bias electric-source 5 is connected across the electric conductive core 1 and the electric conductive layer 3.

In FIG. 1A a first step is shown in which the photosensitive layer 4 is uniformly charged with a desired electric potential by means of a corona discharge device 7 connected to a corona electric source 6. In the present embodiment, the corona discharge device 7 is arranged at a side facing the electric conductive layer 3. The corona discharge device 7 may be arranged at a side facing the photosensitive layer 4. In this first charging step, the bias electric source 5 functions to uniformly charge the photosensitive layer 4 with a desired electric potential. This step may be effected without using such bias electric source.

In FIG. 1B a second step is shown in which a light image is illuminated toward the photosensitive layer 4 in a direction as shown by arrows. A resistance value of that part of the photosensitive layer 4 which is illuminated with the light image decreases and the electric charge thereon is decreased or eliminated. However, that part of the photosensitive layer 4 which is not illuminated with the light image, still maintains its high resistance value and the electric charge thereon remains as is shown in the right side of FIG. 1B. As a result, an electrostatic latent image is formed on the photosensitive layer 4 which corresponds to the light image illuminated thereon.

In FIG. 1C a third step is shown. Spaced apart from and opposed to the photosensitve layer 4 of the photosensitive screen is an electrostatic record sheet 8 and a grounded field electrode 9. Across the photosensitive screen and the grounded field electrode 9 is connected an acceleration electric source 10 which functions to apply a high electric voltage. A flow of corona ions is directed from a corona discharge device 11 arranged in opposition to the electric conductive layer 3 of the photosensitive screen through the photosensitive screen toward the record sheet 8. In this case, the polarity of the corona electric source 12 is formed in opposition to the polarity of the corona electric source 6 in the first step. As a result, the photosensitive screen mesh produces a force which acts upon the flow of corona ions in different directions as shown by arrows. That is, that part of the photosensitive screen mesh at which the electric charge on the photosensitive layer 4 is still present functions to produce a force which acts upon the flow of corona ions in a direction which is adapted to accelerate passage of the flow of corona ions. However, that part of the photosensitive screen mesh at which the electric charge on the photosensitive layer 4 is absent, function to produce a force which acts upon the flow of corona ions in a direction which is adapted to block passage of the flow of corona ions. The force of blocking the passage of the flow of corona ions is determined by a bias electric voltage applied across the two electric conductive layers 1, 3 of the photosensitive screen by means of the bias electric source 13. The force of accelerating the passage of the flow of corona ions is determined by a value obtained by subtracting the bias electric voltage applied across the two conductive layers 1, 3 from the surface electric potential on the photosensitive layer 4.

The above described electrographic process is capable of obtaining a plurality of copies by repeating the third step shown in FIG. 1C after an electrostatic latent image has once been formed on the photosensitive screen.

The reasons why a plurality of copies are obtained by repeating the third step shown in FIG. 1C will now be described. The flow of ions is blocked in its passage through the photosensitive screen by the light illuminated part thereof, and is collected by the electric conductive layer 3 of the photosensitive screen and then flows toward the bias electric source 13. The flow of ions is accelerated in its passage through the photosensitive screen flows toward the grounded field electrode 9, due to high electric voltage field applied across the grounded field electrode 9 and the photosensitive screen. As a result, both the flows of corona ions do not reach to the photosensitive layer 4, so that the electrostatic latent image formed thereon is not influenced by the flow of corona ions. Thus, it is possible to obtain a plurality of copies by repeating the third step shown in FIG. 1C.

Figure 2:
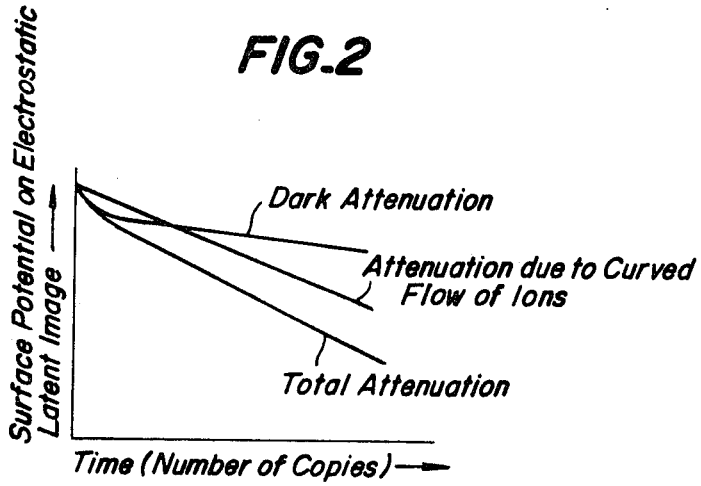
FIG. 2 is a graph showing a plot of change of surface potential on an electrostatic latent image as a function of time.
Figure 3:
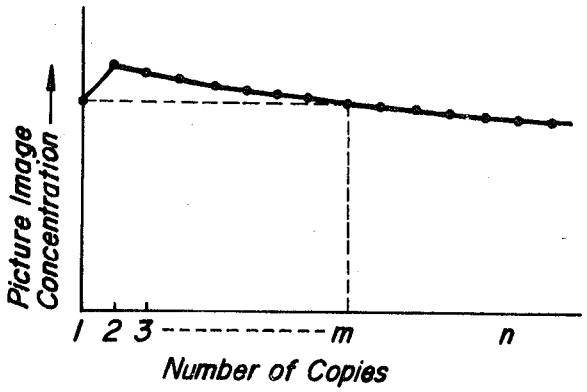
FIG. 3 is a graph showing a plot of picture image concentration as a function of number of copies.

The number of copies to be obtained by the electrostatic latent image which has once been formed on the photosensitive layer 4 is determined by the stability of the electrostatic latent image. As shown in FIG. 2, the surface potential on the electrostatic latent image becomes considerably attenuated as a function of time. This is due to total attenuation resulting from a combination of dark attenuation and attenuation due to a curved flow of corona ions. In addition, experimental tests have indicated that a picture image concentration of a second copy obtained by the same latent image, is higher than that of a first copy and the picture image concentrations of successive copies and gradually decreased as shown in FIG. 3.

The electrographic process according to the invention takes the above mentioned phenomena into consideration and makes the bias electric source 13 variable and causes the bias electric voltage applied across the two electric conductive layers 1, 3 of the photosensitive screen in the third step, to change in response to number of copies to be obtained. Hence a number of copies each having substantially the same picture image concentration are obtained.

Figure 4:
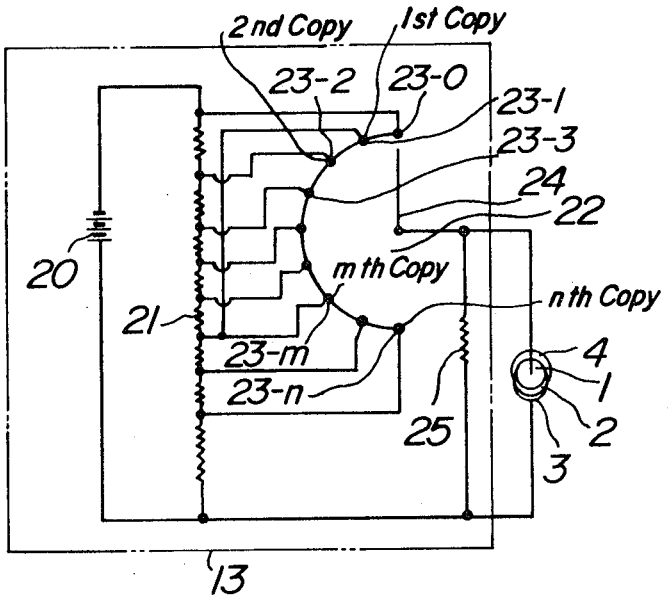
FIG. 4 is a circuit diagram of a bias electric source for practicing the electrographic process according to the invention and changing a bias electric voltage in response to number of copies.

In FIG. 4 a circuit arrangement is shown embodying the bias electric source 13 for supplying variable voltage in response to a number of copies to be obtained. In this embodiment, the bias electric source 13 comprises a battery 20 connected in series with a potentiometer resistor 21 which is provided with a number of taps connected to contacts 23-1, 23-2, 23-3 . . . **23-*m* . . . 23-*n* of a rotary switch 22, respectively. The rotary switch 22 is provided with a change-over arm 24 connected to one end of a stabilizing resistor 25 and to the electric conductive core 1 of the photosensitive screen. The other end of the stabilizing resistor 25 and the electric conductive layer 3 of the photosensitive screen, are connected to a positive terminal of the battery 20 whose negative terminal is connected to a contact 23-0 of the rotary switch 22. The change-over arm 24 of the rotary switch 22 is driven by a suitable driving mechanism (not shown) so as to successively contact the contacts 23-1, 23-2, 23-3 . . . 23-*n* . . . 23*n* in response to number of copies to be obtained. That is, the change-over arm 24 is connected to the contact 23-1 when a first copy is to be obtained and connected to the contact 23-2 when a second copy is to be obtained. The change-over arm 24 is successively connected to the contacts 23-3, 23-4 . . . when a third copy, a fourth copy . . . are to be obtained in succession. It is a matter of course that the above mentioned mode of switching-over is matched with the characteristic curves shown in FIGS. 2 and 3. That is, since the picture image concentration of the second copy is higher than that of the first copy, the bias electric voltage applied when the second copy is obtained is made higher than that when the first copy is obtained. The bias electric voltages applied when the third copy, fourth copy . . . are obtained are gradually decreased and the bias electric voltage applied when the mth copy is obtained is made equal to that when the first copy is obtained. In this way, variable bias electric voltages are applied across the two electric conductive layers 1, 3 in response to number of copies to be obtained on the bias of a given program, thereby producing a picture image whose concentration is always substantially constant. In this embodiment, the bias electric voltage necessary for the first step can be obtained when the change-over arm 24 is connected to the contact 23-0 of the rotary switch 22**.

The invention is not limited to the above mentioned embodiment and many modifications and alternations may be made. For example, the photosensitive screen may include a plurality of photosensitive layers instead of one layer. In addition, the shape of the electric conductive core 1 is not limited to one that is circular in cross sectin. The above mentioned embodiment is described with reference to a positive-positive process, but the electrographic process according to the invention may also be applied to a negative-negative process. In the embodiment shown in FIG. 3, the bias electric voltage is changed in a stepwise manner, but the bias electric voltage may be changed in a continuous manner.

What is claimed is:

1. An electrographic process for producing multiple copies, employing a photosensitive screen composed of four layers consisting of an insulating layer, two electric conductive layers formed on diametrically opposite sides of said insulating layer and a photosensitive layer formed on one of said two electric conductive layers, said process comprising the steps of: uniformly charging the photosensitive layer, illuminating the photosensitive layer with a light image to form an electrostatic latent image thereon, positioning a record sheet having a dielectric material layer in an opposed relation to the photosensitive layer of the photosensitive screen, applying a high electric voltage across a grounded field electrode provided in the rear of the record sheet having the dielectric material layer and the electric conductive layer of the photosensitive screen, applying a bias electric voltage across the two electric conductive layers of the photosensitive screen, directing a flow of ions from a corona discharge device arranged at the side of and spaced apart from the electric conductive layer of the photosensitive screen through the photosensitive screen toward the record sheet, and forming an electrostatic charge image corresponding to the electrostatic latent image on the photosensitive screen on the record sheet having the dielectric material layer, repeating the steps of positioning said record sheet and the steps thereafter to obtain a plurality of copies, and changing the bias electric voltage applied across the two electric conductive layers of the photosensitive screen in a direction to compensate for the increasing attenuation of the electric latent image formed on the photosensitive layer when a plurality of copies is to be obtained.

2. An electrographic process as claimed in claim 1, including the steps of: determining a value of said bias electric voltage applied across the two electric conductive layers of the photosensitive screen when a first copy is obtained from the electrostatic latent image formed on the photosensitive screen, whereby the value of the bias electric voltage is not associated with a direction of changing the bias electric voltage applied when successive copies are obtained.

* * * * *